United States Patent [19]

Van Gompel

[11] 4,270,379

[45] Jun. 2, 1981

[54] ROLL STRAIGHTENING TOOL

[75] Inventor: James Van Gompel, Fremont, Ind.

[73] Assignee: Brammall, Inc., Angola, Ind.

[21] Appl. No.: 35,686

[22] Filed: May 3, 1979

[51] Int. Cl.[3] ..... B21D 39/08

[52] U.S. Cl. ..... 72/392; 72/479

[58] Field of Search ..... 72/392, 479; 254/105, 254/106; 299/22

[56] References Cited

U.S. PATENT DOCUMENTS

| | | | |
|---|---|---|---|
| 1,157,073 | 10/1915 | Baash | 72/392 |
| 1,623,405 | 4/1927 | Gocke et al. | 72/392 |
| 1,837,690 | 12/1931 | Sunde | 72/392 |
| 2,185,550 | 1/1940 | Gerdes | 72/392 |
| 2,263,247 | 11/1941 | Raisanen | 72/392 |
| 2,517,547 | 8/1950 | Derginer et al. | 72/392 |
| 2,686,047 | 8/1954 | Duncan | 299/22 |
| 2,687,763 | 8/1954 | Perkins | 72/392 |
| 3,061,916 | 11/1962 | Kretz | 72/392 |
| 3,292,903 | 12/1966 | Meyer et al. | 72/392 |
| 3,312,099 | 4/1967 | Koepf et al. | 72/392 |
| 3,347,522 | 10/1967 | Reinmann | 254/105 |
| 3,408,848 | 11/1968 | Lague et al. | 72/705 |
| 3,625,046 | 12/1971 | Van Gompel | 72/392 |
| 3,677,058 | 7/1972 | Van Gompel | 72/393 |

FOREIGN PATENT DOCUMENTS

| | | | |
|---|---|---|---|
| 1324709 | 7/1973 | United Kingdom | 72/392 |

*Primary Examiner*—Lowell A. Larson

*Attorney, Agent, or Firm*—Hill, Van Santen, Steadman, Chiara & Simpson

[57] ABSTRACT

Apparatus that is used to expand a collapsed hollow core of a damaged roll which includes an expandable bullet, uniformly expandable along its length by hydraulic cylinders, after being pulled into the core by means of a hollow piston ram and a drawbar. The bullet has an unexpanded cross-section of a football-like shape the area of which is about 10% less than the cross-sectional area of the hole in the undeformed core, allowing over expansion of the bullet which pulls the sides of the core in to form connecting chords. Add-on shells for larger cores are adaptable to the expandable base bullet.

6 Claims, 12 Drawing Figures

ROLL STRAIGHTENING TOOL

BACKGROUND OF THE INVENTION

1. Field of the Invention

This invention relates to the field of roll straightening devices.

2. The Prior Art

It is at times necessary to re-expand to a cylindrical shape, the core or roller upon which is wound a roll of sheet goods. This is currently being done by means of non expandable bullets of predetermined sizes being drawn through a roll or core whose interior diameter is equal to the exterior diameter of the bullet. This method suffered from the need to have a bullet for each core or roll size to be straightened and also from a need to be able to exert sufficient force to draw the bullet into the core without telescoping the core relative to the sheet goods, keeping in mind that extreme force is needed when the exterior diameter of the bullet is equal to the interior diameter of the core. Exerting this force upon a partially flattened core or roll causes the core to telescope during the drawing process.

BRIEF SUMMARY OF THE INVENTION

This invention is a combination of a hollow piston ram or drawing means, connected to a bullet which is expandable within the core to be straightened. The expandable bullet includes hydraulic cylinders operable upon insertion of the expandable bullet into the core to be straightened. When the core is properly positioned the hydraulic cylinders, or hydraulic means expand the bullet uniformly along its length so as to straighten the core. The expanding bullet is expandable to a circumference greater than the core or spindle in which it is positioned and which is to be straightened. The unexpanded bullet has a football-like shape. Upon expansion the interior of the roll or core being straightened is reshaped to the non-circular cross-section of the expanded bullet. The top and bottom of the expanded bullet have circular cross-sections matching the undeformed interior diameter of the core being straightened. 3" I.D. cores are the most popular sized cores in use today for the winding and temporary storage of thin calipers of paper and other sheet goods. Heavier calipers of sheet goods are generally wound on cores of a greater diameter, the core size increasing with the increased caliper size. As a result there are cores having 4", 5" and 6" I.D.'s. Shells, also having a football-like cross-section, may be added onto the basic expandable bullet thus permitting larger diameter cores to be expanded.

More often than not a damaged core in a roll of stock has the appearance or shape of an ellipse or a football, the shape varying somewhat depending on the severity of damage, hence it becomes necessary when addressing the damaged condition with the bullet, that you mate the elliptical shape of the bullet with the corresponding football-like shape of the core. By properly orienting the shape of the bullet to the shape of the damaged core, the expansion of the bullet is likewise directed properly resulting in good roll straightening procedure.

DETAILED DESCRIPTION OF THE PREFERRED EMBODIMENT

Figure 1:
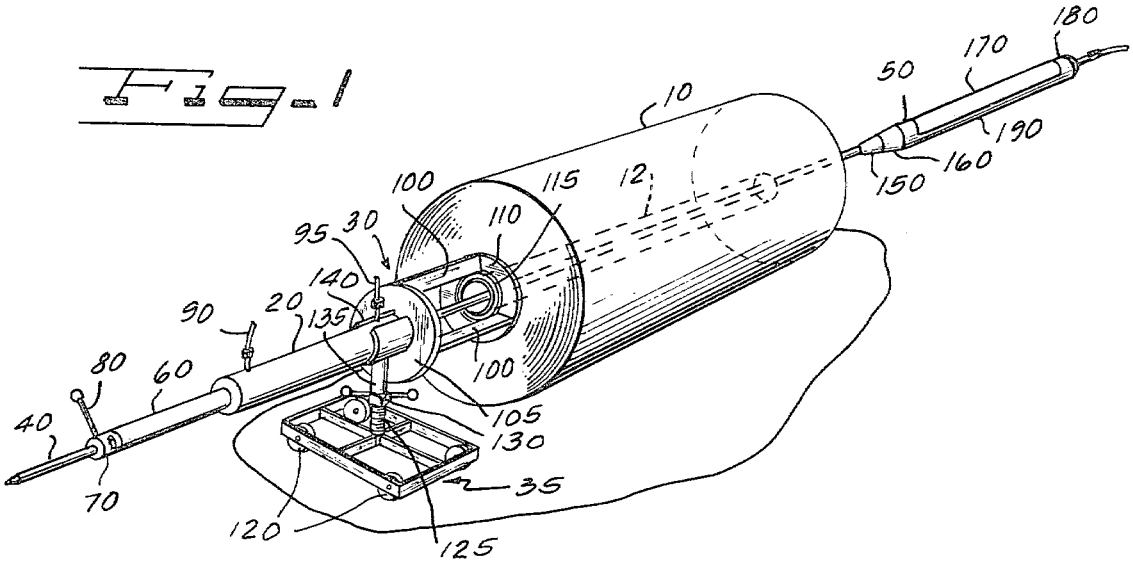
FIG. 1. An over-all view of the roll straightening tool with the draw bar extending through the hollow core and affixed to the expandable bullet.

While the principles of the present invention have a particular utility in a roll straightening tool, it will be understood that the expandable bullet and insertion means of the present invention may be utilized in other combinations. By way of exemplary disclosure of the best mode of practicing the invention and without limitation there is shown generally in FIG. 1 a roll 10 with a core 12 next to which is positioned a hollow piston ram 20 having an associated stand off bracket 30 with a movable dolly 35 and a draw bar 40 positioned through the hollow piston ram 20 extending through the core 12 of the roll 10 and affixed to an expandable bullet 50. The hollow piston ram 20 has a hollow piston 60 which has mounted on it a releasable smooth bar gripper 70 having a handle 80 for releasing and clamping the gripper 70, which is of a standard variety, against the draw bar 40. The hollow piston ram 20 also has a pair of hydraulic couplings 90 and 95. The coupling 95 is operational to extend the hollow piston 60 out of the ram 20, and coupling 90 is effective to retract the hollow piston 60 back into the ram 20. The couplings 90 and 95 are of a standard variety. The associated stand off bracket 30 has three spacers 100 which serve to space a stand off plate 105 forming one end of the stand off bracket 30 from a roll and material retaining plate 110. The roll and material plate 110 has various sizes of interchangeable core restrainers 115 to prevent the core 12 from telescoping with respect to the roll of goods 10 as the bullet 50 is being pulled into position by the hollow piston ram 20. Further, the plate 110 also is shaped so as to restrain the material on the roll 10 from telescoping also when the bullet 50 is being pulled into position. The dolly 35 has a set of wheels 120 for movement and a screw adjustment 125 which can be used to set the height of the hollow piston ram 20 by means of an adjustment handle 130 which is effective to raise and lower a strut 135 which is connected to a receiver 140 which in turn supports the hollow piston ram 20.

By way of example, an operation would proceed as follows. The roll 10 is placed in some convenient position. The dolly 35 supporting the receiver 140 and the hollow piston ram 20 is moved in position such that the proper size core restrainer 115 is aligned with the hollow core 12 of the roll 10. The draw bar 40 is pushed through the core 12 of the roll 10 and through the hollow piston 60 of the hollow piston ram 20. The bullet 50 is affixed to the draw bar 40 and the smooth bar gripper 70 is activated by moving the handle 80 into the gripping position. Hydraulic fluid is then pumped into the extension coupling 95 thereby causing the hollow piston 60 to extend out of the ram 20. As a result, the draw bar 40, being held by the smooth bar gripper 70, follows the hollow piston 60 and pulls the bullet 50 into the core 12 of the roll 10. When the piston 60 reaches its extended length, the hydraulic pressure is released from the coupling 95 and the smooth bar gripper 70 is released by moving the handle 80 into the released position. Hydraulic fluid is then applied to the hollow piston ram 20 via the hydraulic coupling 90 which in turn causes the hollow piston 60 to retract into the hollow piston ram 20. When the ram 60 is fully retracted, the smooth bar gripper 70 is again actuated to grip the draw bar 40 by moving the handle 80 into the gripping position, hydraulic pressure is released from the hydraulic coupling 90 and redirected to the coupling 95 as previously. In this manner via a series of pulling operations the bullet 50 will be properly positioned within the core 12 of the roll 10. Further, because of the effect of the core restrainer 115 and the plate 110 neither the core nor the material abutting plate will be allowed to telescope under these operations.

Figure 2:
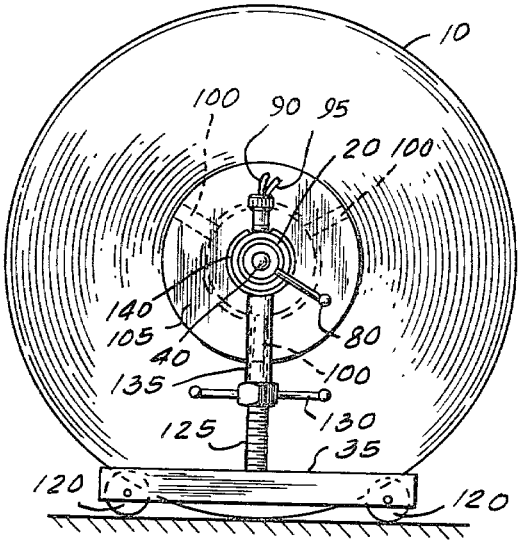
FIG. 2. An end view of the roll straightening tool looking toward the draw bar.

FIG. 2 is an end view showing the dolly 35 having the wheels 120, adjusting threads 125, an adjusting nut with handle 130, the supporting strut 135 and the receiver 140 affixed to the supporting strut 135 in front of the roll 10, adjusted to the proper height so that the draw bar 40 of the hollow piston ram 20 will extend through the core 12 of the roll 10.

Figure 3:
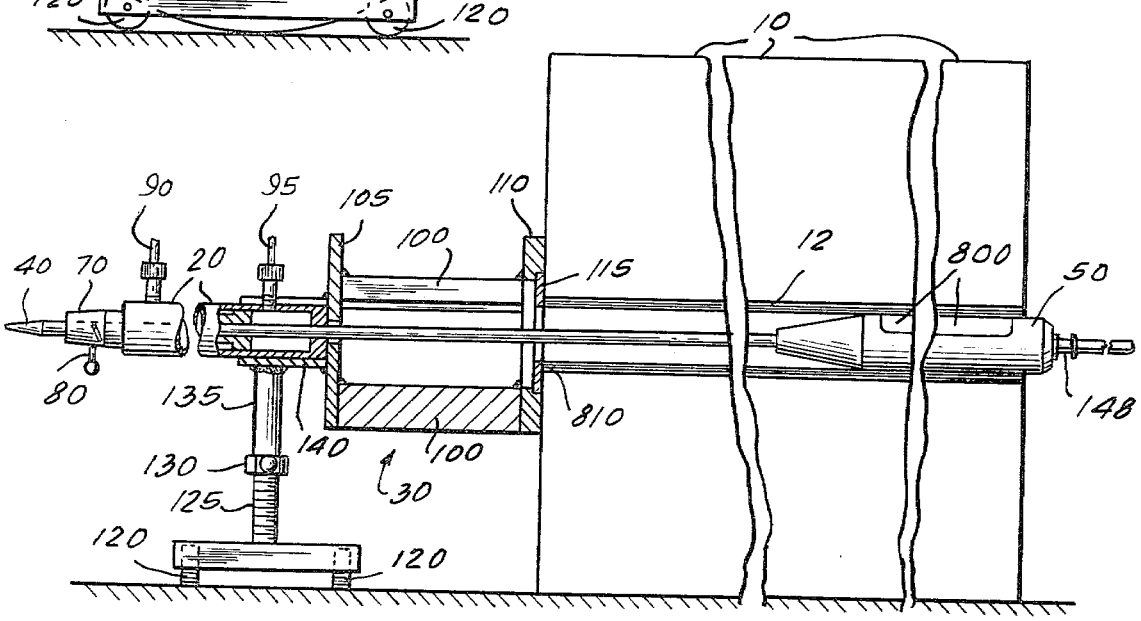
FIG. 3. A partial section showing the stand-off bracket and receiver supporting the hollow piston ram.

FIG. 3 is a partial section showing some of the detailed structure of the invention with the bullet 50 partially pulled into the core 12 of the roll 10. The stand off bracket 30 has the extension brackets 100 attached to the plate 110 which bears against the roll 10 in cooperation with the various sizes of interchangeable core restrainers 115. The restrainers 115 line up with various size cores 12 to prevent telescoping of the core 12 when the bullet 50 is being pulled into position. The bullet 50 has a hydraulic coupling 148 affixed to its posterior through which hydraulic fluid is supplied to expand the bullet 50.

Figures 4, 5, 6, 7:
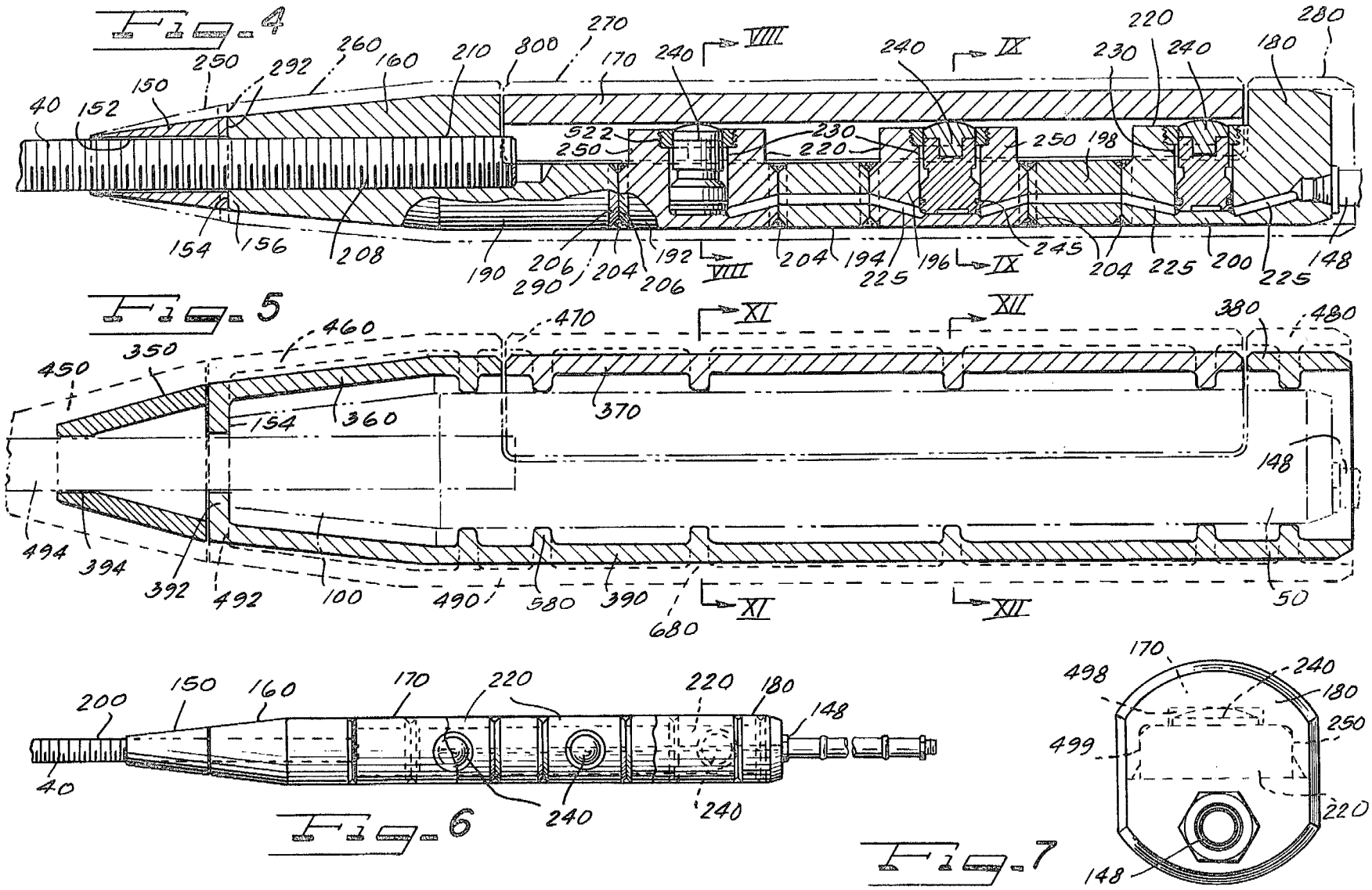
FIG. 4. A section of the three inch basic bullet with the four inch add-on shell indicated.
FIG. 5. A section of the five inch add-on shell with the six inch add-on shell indicated.
FIG. 6. A top view of the basic bullet.
FIG. 7. An end view of the basic bullet.

FIG. 4 is a cross section showing the details of the basic three inch diameter bullet 50. When in position for straightening, the nose cone 150 is attached to the drawbar 40 by means of a threaded hole 152. The rear surface 154 of the nose cone 150 bears againt the front surface 156 of the body 160. The bullet 50 is composed of the nose cone 150, the body 160, a shoe 170, and a heel 180. The nose cone 150 of the three inch bullet shown in FIG. 4 is removable. The body 160, the shoe 170, and the heel 180 represent a basic structure upon which the other larger size sleeves and shoes and heels are added. The larger size sleeves, shoes and heels also have associated with them various size nose cones which must be used to replace the nose cone 150 which forms the front of the basic three inch bullet. While the nose cone 150 is removed when using the bullet in larger size configurations, the body 160 and shoe 170 and heel 180 of the basic three inch bullet are retained and a larger sleeve, shoe and heel for each size is merely affixed over them. The body 160 and the heel 180 are joined by sections 190, 192, 194, 196, and 198 and a second 200, the lower portion of the heel 180. The sections 190, 192, 194, 196, 198 and 200 are all welded together at joints 204. The joints 204 each have associated V-grooves 206 which, after welding are smoothed out resulting in the streamlined shape of the basic bullet 50.

For purposes of carrying out the drawing process the draw bar 40 has a threaded end 208 which matches the threaded end 210 in the nose 160 of the basic bullet 50. To affix the bullet 50 to the draw bar 40 it is only necessary to rotate the draw bar 40 into the threaded end 210 of bullet 50. To produce the desired expansion of the basic bullet 50 after it has been drawn into position, two or more hydraulic cylinders 220 are located within the body of the basic bullet 50 and beneath the shoe 170. As hydraulic fluid is forced through the coupling 148 it travels through the interconnected channels 225 within the body of the bullet 50 entering beneath the pistons 240 in the hydraulic cavities 230 and thereby lifting the rams 240. Seals 245 are located near the bottom end of each of hydraulic rams 240. As the hydraulic fluid is forced through the coupling 148, it causes the hydraulic rams 240 to lift the shoe 170 up uniformly thereby rounding the flat portion of core 12 of the roll 10. During the time the bullet 50 is being drawn into the core 12, the shoe 170 is held from longitudinal movement by the heel 180. When the hydraulic rams 240 are expanding and forcing the shoe 170 upward, the shoe's relative position is retained by friction and pressure of the core 12 around it, as well as the general shape of the heel 180 and the sleeve 160 and shoulders 250 of the cylinders 220. When the hydraulic pressure through the coupling 148 is released the roll 12 recedes forcing the shoe 170 to return to the basic bullet shape 50 and it assumes its non-pressurized position.

In FIG. 4 in dashed lines around the basic bullet 50 is shown the outline for the add-on four inch diameter bullet. It consists of a nose cone 250 which replaces the three inch diameter nose cone 150, a four inch sleeve 260 which fits over the existing three inch sleeve 160 a four inch shoe 270 which fits over the existing three inch shoe 170, a heel 280 which fits over the existing heel 180 and a connecting portion 290 which fits over the pre-existing body portion of the three inch bullet consisting of the welded sections 190,192,194,196,198 and 200. The sleeve 260 via a surface 292 also bears against the basic three inch diameter sleeve at the surface 154. The nose cone 250 also has a boring therethrough for the drawbar 40.

FIG. 5 shows the add-on five inch diameter and six inch diameter housings which may be used along with the basic three inch diameter bullet 50. For the five inch size, the nose cone 350 has replaced the basic three inch nose cone 150, the sleeve 360 fits over the basic three inch sleeve 160, the shoe 370 fits over the basic three inch shoe 170, the heel 380 fits over the basic three inch heel 180 and the body 390 connects the expanded 5 inch diameter sleeve 360 to the heel 380. The front surface 392 of the sleeve 360 bears against the front surface 154 of the sleeve 160. The nose cone 350 has a boring 394 therethrough for the drawbar 40.

In the case of the six inch diameter system, a nose cone 450 replaces the basic three inch nose cone 150, a sleeve 460 slides over the basic three inch sleeve 160, a shoe 470 slides over the basic three inch shoe 170, a heel 480 slides over the basic three inch heel 180 and a body structure 490 connects the sleeve 460 with the heel 480. The front surface 492 of the sleeve 460 bears against the front surface 154 of the sleeve 160. The nose cone 450 has a boring 494 therethrough for the drawbar 40 to pass through. Thus, as can be seen, except for removing the various size nose cones, the other portions necessary to increase the size of the bullet 50 simply slide over the existing three inch structure.

FIG. 6 is a top view of the three inch bullet. As can be seen, the drawbar 40 with its threaded end 200 is screwed into the sleeve structure 160 after passing through the nose cone 150. The shoe 170 rests on the three hydraulic cylinders 220 between the sleeve 160 and the heel 180. Hydraulic fluid is pumped into the posterior coupling 148.

FIG. 7 is a rear view of the basic three inch bullet showing the hydraulic coupling 148, the heel 180, and the position of the hydraulic cylinders 220. As can be seen from FIG. 7, the ram 240 bears against a surface 498 of the shoe 170 raising it thus straightening the core 12 of the roll 10. The shoulders 250 of the hydraulic cylinder 220 mate with the surfaces 499 of the shoe 170 providing alignment against twisting while straightening the core 12.

The length of the basic three inch bullet 50 is twenty-nine inches. This is divided up between the shoe 170 which is 18 inches long, the heel 180 which is two inches long, the sleeve 160 which is six inches long, and the nose cone 150 which is three inches long. Lengths of the various components can vary as desirable.

Figure 8:
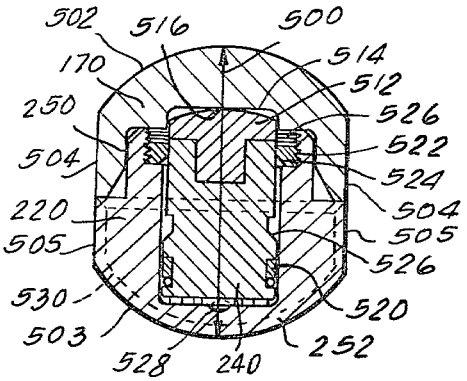
FIG. 8. Section VIII—VIII of the detailed construction of a hydraulic cylinder within the basic three inch bullet.

FIG. 8 is a cross section showing the geometry of the basic three inch bullet taken through one of the hydraulic cylinders 220 and the expandible shoe 170. It is an important feature of this invention to note that the geometry of this cross-section is not circular. The compass point for the radius of the top curve 502 is below the compass point of the radius of the bottom curve 503 with both radii being equal and on a vertical line, giving the basic bullet 50 an elliptical shape or a football shape. The imaginary points of the football are then cut off leaving flat surfaces 504 and 505. The shoe 170 and the hydraulic ram 240 in the case of the basic bullet 50 are designed to be pulled into place within a three inch diameter core. Since the dimension 500 is less than 3", the basic bullet 50 is going to meet less resistance when going into the core 12, than if it had a three inch diameter circular cross section. Once the bullet 50 is properly positioned and pulled into the core 12, hydraulic fluid applied to the coupling 148 will cause the shoe 170, due to the force exerted by the hydraulic cylinder 240, to expand to a dimension greater than 3" or until said core touches sides 504 and 505 of base bullet. The curvatures 502 of the shoe 170 and 503 of the hydraulic cylinder 220 correspond to the curvatures of arcs of a three inch diameter circle. Additionally, the sides 504 of the shoe 170 and 505 of the hydraulic cylinder 220 have been flattened as indicated in FIG. 8. As a result, it is possible for the shoe 170 to be overexpanded. This is to say, because a three inch diameter is not being imposed upon the roll 10 in all directions but only in the direction indicated by the dimension 500, the shape of the roll 10 can be distorbed somewhat, so that the dimension 500 of the basic bullet 50 can exceed three inches and this causes the sides of the roll 10 to move against the sides 504 and 505 of the bullet 170 and the cylinder 220 to assume the linear shape of chords of a circle. The effect of being able to overexpand the core 12 in the direction indicated by the dimension 500 and having the side areas 504 and 505 flat into which the core can move under the effect of the overexpansion due to the shoe 170, produces results much better than the old method of trying to pull a three inch diameter cross-sectional non-expandable bullet through a roll having a three inch inside diameter.

FIG. 8 also discloses the details of the hydraulic cylinder 220. Each cylinder 220 has a ram 240 which has crown cap 512 which bears against the inside 514 of the shoe 170 at the high point 516. The purpose of the crown cap 512 is so that the forces applied on the ram 240 by the shoe 170 at the surface 514 tend to be centered as much as possible in the direction of travel of the piston 240. Further, the crown in the cap 512 tends to permit the shoe 170 to wobble a little from side to side under the unequal forces inherent in a crushed roll 10. The cylinder 220 has a hydraulic seal 520 of a conventional variety and a retaining ring 522 which has a stop 524 which mates with a corresponding surface 526 on the ram 240 to prevent the ram 240 from exceeding allowable displacement. The retaining ring 522 has a groove of a conventional variety into which a spanner wrench would fit for insertion and removal. Hydraulic fluid is brought into the cylinder 220 or expelled from it by the port 528. The dash lines 530 indicate the chamfer of the interconnecting sections 192 through 200 which interconnect the hydraulic passageways 225 and also to the nose section 160.

Figure 9:
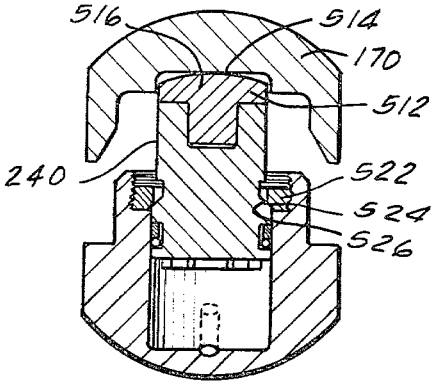
FIG. 9. A view of Section VIII—VIII with the hydraulic ram expanded.

FIG. 9 illustrates section VIII—VIII with the ram 240 of the cylinder 220 fully extended. As can be seen, the shoe 170 bears against the top 516 of the crown 512 at the surface point 514. The retaining ring 522, is restraining the ram 240 from further expansion by having the surface 524 of the retaining ring 522 bear against the surface 526 of the ram 240.

Figure 10:
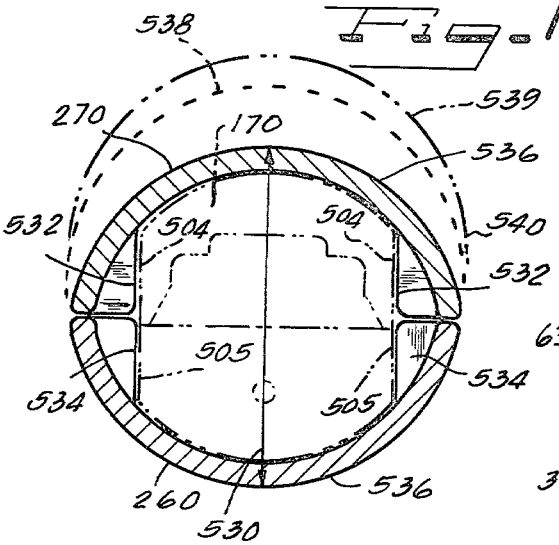
FIG. 10. A view of Section X—X of the four inch diameter add-on shell.

FIG. 10 discloses a cross section taken along line X—X and illustrates the shape and structure of the four inch diameter shoe 270 and the four inch diameter sleeve 260. As can be seen in the case of the basic three inch diameter bullet, the four inch diameter structure has a similar football shape. Dimension 530 is approximately 3 and $\frac{3}{8}$ inches for the four inch structure. As can be seen from FIG. 10 the shoe 270 for the four inch structure rests on top of the shoe 170 of the three inch structure. The gussets 532 of the four inch shoe 270 mate with the sides 504 of the three inch shoe 170 and provide alignment and support for the four inch shoe 270. The gussets 534 of the sleeve 260 of the four inch structure mate with the sides 505 of the hydraulic cylinders 220 and the innerconnecting sections 194, 198 and the lower portion 190 of the basic sleeve 160. The curvature 536 of the shoe 270 and the sleeve 260 corresponds to the curvature of a four inch diameter circular cross section. Thus, just as in the case of the basic bullet 50, as the rams 240 force the shoe 170 apart, the shoe 170 in turn forces the shoe 270 apart from the sleeve 260 in the four inch diameter structure. As a result the same effect is achieved with the four inch diameter structure in that the bearing curvatures 536 push against the inside surfaces 538 of the four inch diameter core 12 and can force the core 12 into an overexpanded condition 539, due to the fact that the sides of the core 12 can be stretched out, forming chords between the ends of the shoe 270 of the sleeve 260.

Figure 11:
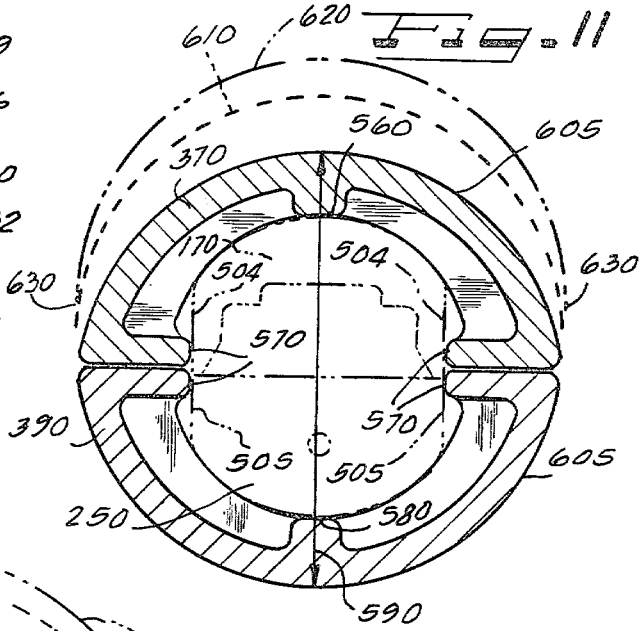
FIG. 11. A view of Section XI—XI of the five inch diameter add-on shell.

FIG. 11 illustrates cross section XI—XI showing the structure for the five inch diameter bullet. The basic three inch diameter shoe 170 bears against the five inch diameter shoe 370 and supports it at the surface 560. The webs 570 of the shoe 360 bear against the surfaces 504 and 505 of the shoe 170 and the hydraulic cylinder 220 along with the interconnecting structures 194 and 198. The basic bullet 50 is also supported at the point 580 by the sleeve 390. The unexpanded dimension 590 of the five inch diameter bullet is approximately 4-7/16". The curvature 605 of the shoe 360 and the sleeve 390 correspond to the curvature of a five inch diameter circular cross section such that when the five inch diameter shoe is expanded, it matches the dash five inch diameter circle 610. The dashed lines 620 indicate the overexpanded condition for the five inch diameter shoe again creating chords at 630 as the core of roll 10 is drawn in as the dimension 590 is increased by additional expansion.

Figure 12:
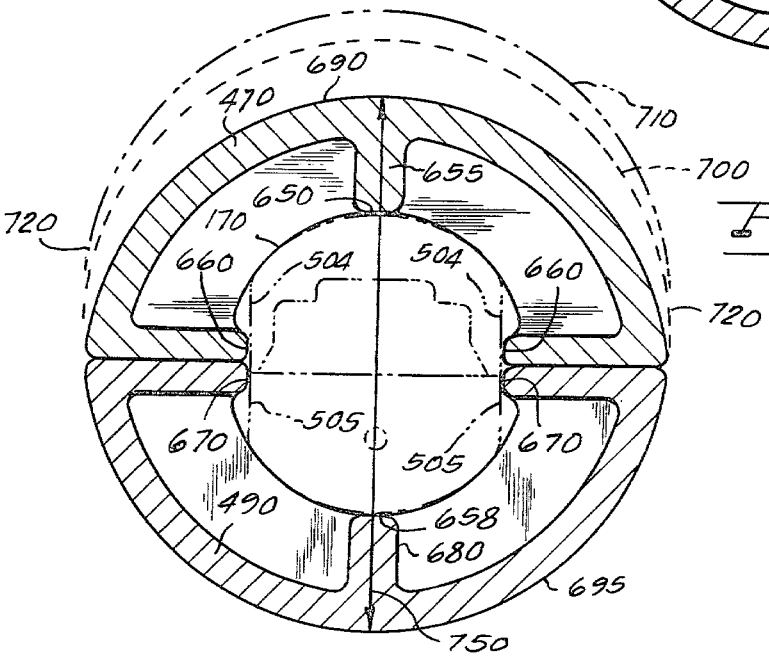
FIG. 12. A view of Section XII—XII of the six inch diameter add-on shell.

FIG. 12 illustrates the structure of the six inch diameter bullet. FIG. 12 is a cross section taken along the lines XII—XII. The shoe 470 with a six inch diameter bullet is supported on the basic three inch diameter shoe 170 by the surface 650 of the support 655. The surfaces 660 of the shoe 470 and 670 of the sleeve 490 mate with the surfaces 504 and 505 of the basic shoe 170 and hydraulic cylinder 220 or the interconnecting structures 194 or 198, respectively. These mating surfaces serve to align and keep in position the shoe 470 during the period of time that the shoe 170 is causing it to expand by forcing upward against the support 655. The sleeve 490 of the six inch diameter bullet is supported by the bracket 680 at the surface 685. With respect to the bottom of the basic three inch diameter bullet 50, when expanded, the shoe 470 with a curvature 690 and the housing 490 with a curvature 695 correspond to the six inch diameter circle 700 shown in dash lines of FIG. 12. When over expanded, the shoe 470 and sleeve 490 correspond to the dash line 710 which in turn also displays the flattened side surface 720 into which the sides of the core 12 are drawn. The unexpanded diameter 750 of the six inch shell is approximately five and seven-sixteenth inches.

At this point it will be appreciated that the spacers 100 of the stand-off bracket 30 must be long enough so that when the bullet 50 in whatever size it happens to be structured, can be pulled forward far enough out of the end of the core 12 so that the front end 800 of the shoe 170 or 270 or 370 or 470 depending on the respective size roll being straightened, will match the front end 810 of the roll 10 before that end 810 can attempt to be straightened. Additionally it should be noted that the sizing discs 115 are interchangeable and the correct size is selected having a circular opening which equals the interior dimension of the core or the roll 10 to be straightened. The purpose of this is to prevent the core from telescoping relative to the roll during the straightened process.

Although various modifications might be suggested by those skilled in the art, it should be understood that I wish to embody within the scope of the patent warranted hereon all such modifications as reasonably and properly come within the scope of my contribution to the art.

I claim as my invention:

1. In a roll straightening apparatus with a bullet having an expansion shoe mounted thereon, a hydraulic cylinder mechanically mounted within said bullet; and a common hydraulic connection at one end of the bullet wherein the expansion shoe moves laterally in response to hydraulic fluid being supplied to said hydraulic cylinder by means of the common hydraulic connection an improvement comprising: smooth, curved, exterior surfaces on said shoe and on said bullet, a drawbar arranged with a mechanical mating means at one end to connect with the opposite end of said bullet; a hollow piston hydraulic ram with a hollow movable piston adapted to move said drawbar horizontally, having means for mechanical support with respect to a work surface such that the distance between said hollow piston and the work surface is adjustable; and wherein said means for mechanical support includes an annular shaped restraining member removably mounted and positionable adjacent an end of a hollow core of the roll to be straightened to apply force to the roll to prevent telescoping as said bullet is pulled into the roll from the opposite end by horizontal movement of said drawbar.

2. The roll straightening apparatus according to claim 1 including further at least one pair of expander shoes to be used to straighten rolls having various sizes of interior radii, each said pair of expander shoes includes an elongated first and second expander shoe, said first expander shoe has an inner region adapted to receive the expansion shoe in the bullet and a smooth outer curved surface, said second expander shoe has an inner region adapted to receive a lower portion of the bullet, beneath the hydraulic cylinder, and a smooth outer curved surface, said smooth outer curved surfaces each correspond in cross-sectional shape and length to an arc of a circle with a radius of curvature equal to the interior radius of curvature of the roll to be straightened and with a length a selected amount less than one-half of the circumference of the circle such that in an unexpanded condition the longitudinal edges of each of said outer curved surfaces are adjacent one another, said outer curved surfaces are adapted when forced apart by the hydraulic cylinder in the bullet to apply force to the interior of the roll to be straightened substantially around the entire interior circumference of the roll.

3. In an expanding apparatus usable to expand a hollow cylindrical roll of material, the apparatus has an elongated body having a tapered front end and a shoe laterally movable by means of a hydraulic cylinder in the body, an improvement comprising:

a curved, smooth lower surface on said body, an axially oriented threaded hole in said tapered front end of said body, and means for pulling said body into position within the roll to be straightened comprising:

a rod with a threaded end adapted to engage said threaded hole in said front end of said body, hydraulic means for moving said rod and said body essentially horizontally to pull said body into position within the roll to be straightened.

4. The apparatus according to claim 3 including further:

first and second elongated expander shoes to adapt the apparatus to expand rolls having an interior radius greater than the unexpanded height of said body, said first elongated expander shoe has an interior region that is adapted to receive the laterally movable shoe therein, said interior region includes a pair of spaced apart surfaces adjacent a pair of spaced apart straight sides on the laterally movable shoe to prevent rotary movement of said first elongated expander shoe with respect to the body, said first elongated expander shoe has a smooth, curved exterior surface, said exterior surface has a curvature corresponding to the curvature of the interior of the roll to be straightened and an arc length a selected amount less than one-half the circumference of the interior of the roll to be straightened and a selected amount greater than one-quarter of the circumference of the interior of the roll to be straightened, said second elongated expander shoe has an interior region adapted to receive a section of the elongated body extending beneath and adjacent the hydraulic cylinder, said interior region includes a pair of spaced apart surfaces adjacent a pair of spaced apart straight sides on the body to prevent rotary movement of said second elongated expander shoe with respect to the body, said second elongated expander shoe has a smooth, curved exterior surface, said smooth curved exterior surface has a curvature corresponding to the curvature of the interior of the roll to be straightened and an arc length a selected amount less than one-half the circumference of the interior of the roll to be straightened and a selected amount greater than one-quarter of the circumference of the interior of the roll to be straightened.

5. The apparatus according to claim 4 wherein said means for pulling includes further:

vertically adjustable supporting means to adjustably support said hydraulic means for moving said rod, said supporting means includes a vertically mounted, removable disk shaped restraining means with an axial hole of a selected radius therein through which extends said rod, whereby said supporting means is positionable with said restraining means adjacent the hollow cylindrical opening in the roll to be straightened to apply force to the end of the portion of the roll adjacent the hollow cylindrical section to prevent telescoping of the roll as the expandable body is pulled through the roll from an opposite end.

6. In a roll expanding apparatus with an elongated body having a tapered front end and a shoe laterally movable by means of a hydraulic cylinder in the body an improvement comprising:

first and second elongated expander shoes to adapt the apparatus to expand rolls having an interior radius greater than the unexpanded height of said body, said first elongated expander shoe has an interior region that is adapted to receive the laterally movable shoe therein, said interior region includes a pair of spaced apart surfaces adjacent a pair of spaced apart straight sides on the laterally movable shoe to prevent rotary movement of said first elongated expander shoe with respect to the body, said first elongated expander shoe has a smooth, curved exterior surface, said exterior surface has a curvature corresponding to the curvature of the interior of the roll to be straightened and an arc length a selected amount less than one-half the circumference of the interior of the roll to be straightened and a selected amount greater than one-quarter of the circumference of the interior of the roll to be straightened, said second elongated expander shoe has an interior region adapted to receive a section of the elongated body extending beneath and adjacent the hydraulic cylinder, said interior region includes a pair of spaced apart surfaces adjacent a pair of spaced apart straight sides on the body to prevent rotary movement of said second elongated expander shoe with respect to the body, said second elongated expander shoe has a smooth, curved exterior surface, said smooth curved exterior surface has a curvature corresponding to the curvature of the interior of the roll to be straightened and an arc length a selected amount less than one-half the circumference of the interior of the roll to be straightened and a selected amount greater than one-quarter of the circumference of the interior of the roll to be straightened.

* * * * *